United States Patent [19]

Williams

[11] Patent Number: 4,471,344

[45] Date of Patent: Sep. 11, 1984

[54] DUAL FREQUENCY ANTI-THEFT SYSTEM

[75] Inventor: Harold B. Williams, Los Angeles, Calif.

[73] Assignee: ICI Americas Inc., Wilmington, Del.

[21] Appl. No.: 373,251

[22] Filed: Apr. 29, 1982

Related U.S. Application Data

[63] Continuation of Ser. No. 195,572, Oct. 9, 1980, abandoned.

[51] Int. Cl.[3] ..... G08B 13/18

[52] U.S. Cl. ..... 340/572; 343/6.8 R

[58] Field of Search ..... 340/572; 343/6.8 R, 343/6.5 R

[56] References Cited

U.S. PATENT DOCUMENTS

| | | |
|---|---|---|
| 2,193,102 | 3/1940 | Koch . |
| 3,018,475 | 1/1962 | Kleist et al. . |
| 3,036,295 | 5/1962 | Kleist . |
| 3,182,315 | 5/1965 | Sweeney . |
| 3,467,962 | 9/1969 | LaPlume . |
| 3,609,741 | 9/1971 | Miller . |
| 3,631,442 | 12/1971 | Fearon . |
| 3,631,484 | 12/1971 | Augenblick . |
| 3,665,448 | 5/1972 | McGlinchey et al. . |
| 3,707,711 | 12/1972 | Cole et al. . |
| 3,720,940 | 3/1973 | Fox et al. . |
| 3,754,226 | 8/1973 | Fearon et al. . |
| 3,798,642 | 3/1974 | Augenblick et al. . |
| 3,859,624 | 1/1975 | Kriofsky et al. . |
| 3,863,244 | 1/1975 | Lichtblau . |
| 3,895,368 | 7/1975 | Gordon et al. . |
| 3,932,821 | 1/1976 | McClaskey . |
| 4,063,229 | 12/1977 | Welsh et al. . |
| 4,087,802 | 5/1978 | Williamson . |
| 4,139,844 | 2/1979 | Reeder . |
| 4,249,167 | 2/1981 | Purinton et al. . |
| 4,260,983 | 4/1981 | Falck et al. . |
| 4,303,910 | 12/1981 | McCann . |

FOREIGN PATENT DOCUMENTS 763381 5/1934 France .

OTHER PUBLICATIONS

"Radiotron Designer's Handbook," RCA, 1952, pp. 1125–1130.

McAleer, H. T., "A New Look at the Phase-Locked Oscillator," Proc. IRE. Jun. 1959, pp. 1136–1143.

*Primary Examiner*—Glen R. Swann, III

*Attorney, Agent, or Firm*—Louis F. Kreek, Jr.

[57] ABSTRACT

An article surveillance system employs a label or tag containing a non-linear impedance element, such as a semiconductor diode, connected to a metal antenna loop configured to pick up two distinct radio frequency transmissions displaced on either side of a selected center frequency. The non-linear impedance element connects opposing sides of the metal loop forming a tuned tank circuit that resonates at twice the selected center frequency. Two transmitters generate separate tone modulated radio frequency and continuous wave radio frequencies equally displaced on opposite sides of the center frequency that are fed to respective orthogonally disposed dipole radiating antenna strips on opposite sides of a surveillance area. The dipole strips for different frequencies are at right angles on each side, while those for the same frequency are at right angles to one another on opposite sides to achieve cross polarized transmission of both signals within the surveillance area. These signals are mixed by summing in the non-linear impedance to resonate the antenna tank circuit at double the center frequency which is reradiated to the receiver antennas on each side where a very narrow band receiver detects it. The modulating tone signal derived from demodulating the detected signal produces a gradually increasing charge that is compared against a preselected threshold to trigger an alarm whenever the detected signal is of sufficient strength and duration.

13 Claims, 6 Drawing Figures

DUAL FREQUENCY ANTI-THEFT SYSTEM

CROSS REFERENCE TO RELATED APPLICATION

This application is a continuation, of application Ser. No. 195,572, filed Oct. 9, 1980 now abandoned.

BACKGROUND OF THE INVENTION

1. Field of the Invention

This invention relates generally to electronic article surveillance systems and more particularly, to an article surveillance system that involves the transmission of two distinct radio frequency signals, one of which is tone modulated, that are picked up by a transponder and mixed through a non-linear impedance to be reradiated at a higher frequency equal to their sum, which is detected by a narrow band receiver.

2. Prior Art

Earlier surveillance systems of this type, such as that described in U.S. Pat. No. 4,063,229 to Welsh et al, operate to transmit a single radio frequency to be picked up by an antenna on a transponder tag or label where a non-linear impedance, such as a semiconductor diode, generates a selected harmonic of the transmitted signal that is reradiated for detection by a receiver circuit to the exclusion of the transmitted frequency. However such systems proved unsatisfactory in practice from the standpoint of lacking the sensitivity to reliably detect the presence of a transponder within the surveillance area and of producing false alarms in response to various other conditions.

Significantly, the non-linear characteristics inherent in the transmitter circuitry and elements often resulted in harmonics being transmitted along with the fundamental transmission frequency causing the receiver to respond without the presence of a non-linear impedance element in the transponder. If receiver sensitivity has to be reduced to ignore such directly transmitted harmonics, then lower energy harmonics reradiated by the transponder element under some circumstances might be masked. Although this problem con be minimized by proper shielding and RF filtering in both the transmitter and receiver, the filters would have to be provided with extremely sharp cutoff characteristics so that even a small frequency drift in the transmitted signal, which is multiplied in the harmonic, could easily result in the reradiated frequency being outside of the filter pass band of the receiver. Frequency shifts may also result from the Doppler effect produced in moving the transponder rapidly within the surveillance area thus aggravating the effect of transmitter drift.

On the other hand, such high frequency signals could readily propagate outside of the intended surveillance area to cause false triggering of the alarm by a remote transponder. As a result, protected articles often could not be located or handled anywhere in the vicinity of the surveillance area. Even then, the high frequency energy might propagate by unpredictable reflections, or even along plumbing pipes or power conduits acting as wave guides, to and from remote locations within the protected structure to produce false triggering of the alarm system.

Such systems were also susceptible to false triggering by metal objects such as umbrellas, baby carriages and shopping carts, where a weld or contact point between dissimilar metals produces a non-linear impedance diode effect to generate and reradiate a harmonic of the transmitted signal. Or the receiver could respond to spurious radio frequency noise from other sources such as motor ignition systems and electronic equipment.

Conversely, the system might not respond to the actual presence of a transponder element within the surveillance area if the energy picked up and reradiated as a harmonic were insufficient. For example, this could occur if the transponder antenna were improperly oriented with respect to the polarization of the transmitted field or if the antenna were to be electromagnetically shielded from the transmitter by the human body or metallic surface. Also, proximity of the transponder to the human body can detune the resonant tank circuit, thus dissipating the harmonic energy available for reradiation to the receiver. Moreover, although signal tracking circuitry can be incorported to adjust the frequency response of the receiver to compensate for transmitter frequency drifts, transponder efficiency suffers badly whenever the tuned tank circuit is forced to oscillate at frequencies other than its normal resonant frequency.

Later efforts to resolve the problems of such earlier systems have resulted in several variations. In one of these, which is described in U.S. Pat. No. 3,631,484 to Augenblick, the single radio frequency transmitted to the transponder to be reradiated as a harmonic is compared with signals picked up by the receiver to detect Doppler effect frequency shifts caused by movement of the transponder. Although this system eliminated problems associated with transmitter frequency drift and false alarms from stationary transponders nearby, an article moved slowly through the surveillance area would not produce a Doppler frequency shift sufficient to trigger the alarm.

Attempts were also made to investigate systems wherein the non-linear impedance element in the transponder operated as a signal mixer to generate sum and difference frequencies in response to two transmitted signals of different frequencies, as pointed out in the background discussion of U.S. Pat. No. 3,895,368 to Gordon et al. However, such dual frequency mixer systems were considered to have many practical shortcomings, which included the problem of confining higher frequency transmissions to the intended surveillance area. To overcome this problem, the Gordon et al patent describes use of a dual field system employing a high frequency electromagnetic field in conjunction with a high power, low frequency electrostatic field established between discontinuous conductors diposed on opposite sides of the surveillance space. The non-linear impedance element subjected to these two fields operates as a mixer to produce sum and difference frequencies that are reradiated to the receiver for detection. However, the power required to establish the required electrostatic field within the surveillance area is significant, and such low frequency electrostatic fields can be effectively shielded from the transponder by the human body or by a surrounding conductor and diverted from the transponder through the metallic structure of a shopping cart or the like. Also the low frequency electrostatic field could readily be diverted through nearby pipes and other metal structures to remote locations to cause false triggering by tags far outside the surveillance area, and the problem of false alarms due to dissimilar metal junctions in metal carts and the like was aggravated by concentration of the electrostatic field through such metal structures.

SUMMARY OF THE INVENTION

The present invention provides an article surveillance system wherein a non-linear impedance element, such as a semiconductor diode, is connected to a metal antenna within a removable label or tag attached to a garment or other item of merchandise. The antenna is preferably in the form of a folded dipole with the diode connected between opposite sides of a closed loop section at one end to provide a tuned tank circuit with a resonant frequency double that of a selected center frequency. The longer antenna section extending beyond the diode closely approximates a quarter wavelength at the selected center frequency, which for example may be 915 megaHertz. Resonant frequency of the tank circuit, which is determined by the capacitance of the diode and the inductance of the adjacent closed loop section of the antenna, is double that of the selected middle frequency (e.g., 1830 megaHertz).

Two different radio frequency signals are both transmitted from dipole radiating antennas disposed on the opposite sides of a surveillance area. One of the signals is generated as a continuous wave from a highly stable crystal oscillator source at a fixed frequency (e.g., 905 megaHertz) which is displaced from the selected center frequency by approximately 1%. The other signal being transmitted is tone modulated, preferably with an audio signal in the range of 1 to 20 kiloHertz, to produce a radio frequency deviation of plus and minus 5 kiloHertz in the carrier, which is also derived from a highly stable crystal oscillator source at a frequency (e.g., 925 megaHertz) which is equally displaced from the selected center frequency on the opposite side, so that the mean center frequency of the two signals equals the selected center frequency. Both transmitter signals are radiated across the surveillance area from dipole antenna segments oriented at right angles to one another on the same sides and with the respective dipole segment for radiating the same frequency from opposite sides also being oriented at right angles to one another. This results in cross polarization in the surveillance area of the two radio frequencies being transmitted from opposite sides to insure that radiation of both frequencies in the surveillance area between the transmitters is adequate in all directions to accommodate any orientation of the tag, whereas propagation of both signals from the antennas on only one side to the same remote locations outside the surveillance area is minimized because of their different polarizations. On the other hand, audio modulation of one of the radio frequencies avoids creation of standing wave patterns that can result in blind spots within the surveillance area and false triggering of the system by tags outside the intended area.

Significantly, the dual frequency operation reduces the effect of transmitter frequency drift and increases the system bandwidth in regard to transponder efficiency in reradiating the incident radio frequency signals. In particular, the frequency to which the transponder antenna is tuned may fall anywhere between the two transmitted frequencies without significantly reducing transponder efficiency, thus eliminating any need for precise antenna dimensioning and minimizing problems with "body detuning" whereby the normal tuning point of the transponder is shifted downwardly in frequency due to the dielecteric loading effect of a human body in contact with or in close proximity to the tag. For example, if the transponder antenna is detuned down from the selected center frequency, this merely increases the transponder efficiency relative to the lower transmitted frequency, and the overall mixer action is not seriously affected since proper mixing occurs with radio frequency power ratios of ten to one or even greater. Similarly, the effects of transmitter frequency drift are minimized in that a shift in one of the transmitters is not multiplied as with reradiated harmonics in the single frequency systems, and any drift in one can be offset by an opposite shift in the other transmitter.

The strength and frequency stability of the reradiated transponder signal, and the improbability of triggering a false response from transponders outside the surveillance area permits maximum receiver sensitivity and minimum receiver bandwidth. Signals received from circularly polarized receiver antennas on either side are applied through a very narrow bandpass filter that rejects the transmitter frequencies and then amplified so that the modulating tone can be derived using mostly conventional demodulation techniques. Preferably, the audio tone (e.g., 2 kiloHertz) is used to frequency modulate the radio frequency carrier so that the filtered and amplified signal from the receiver antenna can be applied to a passive double balance mixer that receives a lowerside injection signal (e.g., 1808.600 megaHertz) generated by a stable local oscillator source to provide a suitable intermediate frequency (e.g., 21.4 megaHertz) at the mixer output. This intermediate frequency output from the mixer is amplified and applied to another precision filter with a narrow passband (e.g., 30 kiloHertz) that defines the predetection bandwidth. Detection of the modulating tone is then accomplished through the operation of a narrowband (e.g., 30 kiloHertz) crystal discrimination, the output of which is clamped to ground until its input is of sufficient strength to generate an automatic gain control detector voltage that exceeds a preselected reference level which is adjusted to set the system sensitivity. With the clamp open, the tone is applied to a phase locked loop tone decoder circuit whose voltage controlled oscillator has a free-running frequency equal to that of the tone and is capable of acquiring any steady tone within a narrow frequency range (e.g., plus or minus 10 percent). When the loop acquires the tone signal, a quadrature detector senses the phase locked condition and produces a direct current output voltage to drive an operational amplifier with a capacitive feedback that sustains an output signal to trigger an alarm for some minimum time period (e.g., 3 seconds), no matter how brief the duration of the detected tone. By this means, the alarm is actuated no matter how briefly the transponder remains within the surveillance area once the detected signal is of sufficient strength and has the proper modulated frequency content. This eliminates false alarms by weak return signals from transponders outside of the surveillance area and by signals from extraneous sources that may coincidentally produce signals corresponding to the reradiated frequency, but that lack the required tone modulation.

DETAILED DESCRIPTION

Figure 1:
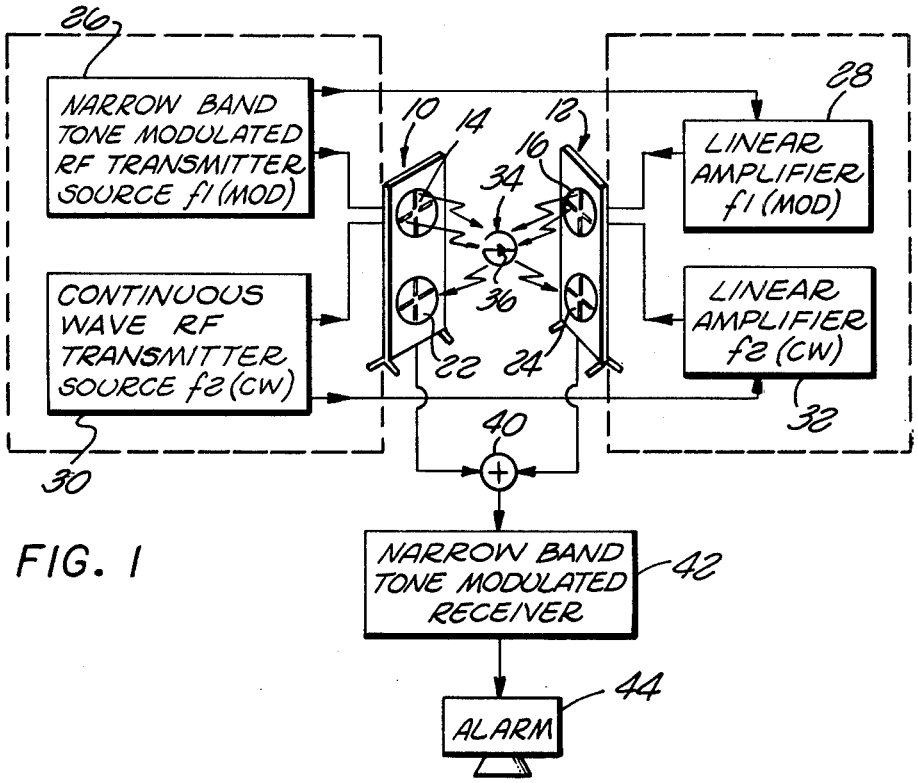
FIG. 1 is a schematic block diagram of the basic circuit elements and a partial perspective showing the antenna placement for an article surveillance system in accordance with the invention.
Figure 2:
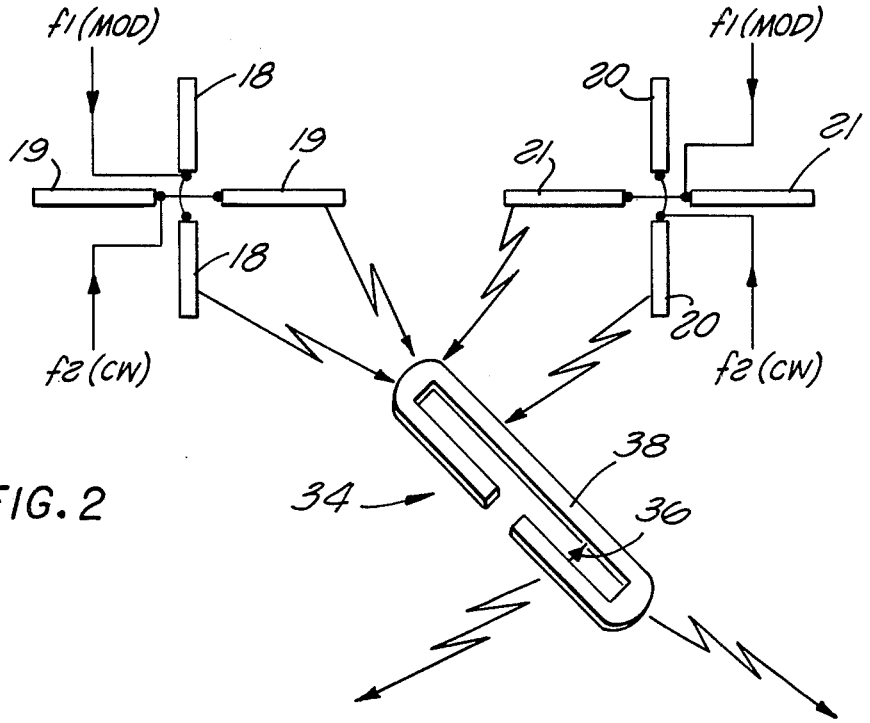
FIG. 2 is a more detailed schematic illustrating the cross polarized orientation of the transmitter antenna segments with a perspective view of the operative antenna and non-linear impedance elements of the transponder.

Referring now to FIG. 1, which illustrates an article surveillance system in accordance with the invention, appropriate transmitter and receiver antenna arrays are mounted in corresponding locations on free standing pedestals 10 and 12, or if preferred on or within existing door frames on either side of a surveillance area, typically at the entrance or exit to a retail establishment, so that anyone entering or leaving must traverse the space between them. Although shown slightly askew in FIG. 1 for illustration purposes, the respective antenna arrays on either side normally directly face one another with the respective antenna elements disposed in parallel vertical planes. The transmitter antenna arrays 14 and 16, as best seen in FIG. 2, both consist of orthogonally disposed pairs of metal strip segments 18, 19, 20 and 21 mounted on a vertical planar backing on either side of the protected access or other area. Each strip extends outward from a central hub area with individual pairs being aligned side to form a conventional center fed dipole radiating antenna that is approximately one-quarter wavelength long for the frequency being transmitted, and may conveniently be oriented as shown to extend horizontally and vertically. The individual strips 18–21 may be cut from conventional copper clad, adhesive backed tape of the type commonly used in printed circuit boards and applied to a non-conductive di-electric backing with suitable low loss characteristics on the pedestal or door frame, or the four strip array can simply be etched out by removing the surrounding conductive surface on a printed circuit board. A conductive metal panel or a small mesh grid (not shown) can be located behind and parallel to the plane of the antenna strips 18 to 21 to reflect and thus concentrate the transmitted signal energy and radiation pattern inwardly across the protected space for greater efficiency and to inhibit radiation of the signals from the opposite side to areas behind the pedestals 10 and 12. In the preferred form of the system, the copper clad tape strips are applied to the surface of a G-10 fiberglass panel that is affixed by adhesive within a lightweight anodized aluminum frame that covers the entire back surface of the pedestal 10 or 12 and structurally supports the antenna mountings and associated circuit elements.

Also mounted on each side are receiver antennas 22 and 24 that are circularly polarized, such as the crossed folded dipole configuration commonly know as a "turnstile" antenna or a helical antenna. The length of each receiver dipole segment should be a quarter wavelength of the frequency reradiated signal which, as hereinafter explained, is equal to the sum of the two transmitted frequencies.

Two distinct radio frequency signals $f_1$ and $f_2$ are generated to be radiated from the respective dipole strip segments 18, 19, 20 and 21 that form the transmitter antenna arrays 14 and 16. The $f_1$ signal is a narrow band modulated radio frequency generated from a highly stable oscillator source 26 that is coupled to the vertical dipole strip segments 18 of the transmitter antenna array 14 on one side and also through a linear amplifier 28 to the opposing horizontal strip segments 21 of the transmitter array 16 on the other side of the surveillance area. The other transmitter signal $f_2$ is similarly generated at a fixed radio frequency by a highly stable oscillator source 30 that is to the horizontal strip segments 19 of the transmitter antenna array 14 on one side, and on the other side through a linear amplifier 32 to the oppositely disposed vertical strip segments 20 in the transmitter antenna array 16. Preferably both oscillator sources 26 and 30 employ respective temperature compensated, crystal oscillators having cascaded frequency multiplier and narrow pass band filters for generating the continuous wave $f_2$ and the radio frequency carrier for the tone modulated signal $f_1$, as more fully described hereinafter in connection with FIGS. 3 and 4.

Generally, the distance between the metal strip antenna segments 18–21 and the adjacent reflective surface of the conductive panel or grid behind it, which depends on the thickness of the low loss dielectric backing, is selected to produce a low voltage standing wave ratio (VSWR) to match the antenna input impedance with the output impedance of the respective transmitter signal source at the transmitted frequency so as to provide an effective radiation pattern with an approximate 60 degree beam width extending outward from the transmitter antenna arrays 14 and 16 on each side.

Both radio frequencies $f_1$ and $f_2$ are thus radiated from transmitter arrays 14 and 16 on opposite sides and with opposite polarizations to intersect and impinge from both sides upon a transponder 34 located in the surveillance area between the two pedestals 10 and 12. The transponder 34 is shown schematically in FIG. 1 as a circularly polarized helical antenna loop with a diode 36 connected across a short closed section of the loop. However, as shown in more detail in FIG. 2, the preferred form of the transducer 34 consists of an elongated flat metal antenna 38 loop with a central gap on one side that provides a folded dipole configuration. The overall antenna length is ideally a quarter wavelength of the mean center frequency between the two transmitted radio frequencies $f_1$ and $f_2$. The non-linear impedance element 36, which takes the form of a semiconductor diode, is connected between opposite sides of the loop near one end about midway from the side gap so that the capacitance of the diode 36 with the inductance of the adjacent closed end of the conductive loop form a tank circuit with a resonant frequency equal to or approximating the sum of the two transmitter frequencies $f_1$ and $f_2$ or, in other words, a resonant frequency twice that of the selected mean center frequency for the transmitter signals. Precise placement of the diode 36 on the antenna loop 38 to produce the desired resonant frequency for the tank circuit is not crucial and for the most part is determined empirically based on the capacitance of the selected diode and the conductive properties of the antenna loop. In operation, the short straight metal segment on the diode side of the gap serves as a quarter wave dipole radiating antenna at the resonant frequency of the tank circuit.

Maximum transponder efficiency and selectivity is achieved where the frequency difference between the two transmitter signals $f_1$ and $f_2$ is somewhere around two percent of their mean center frequency. In the current version of the system, the frequency of the continuous wave signal $f_2$ generated by the source 30 is chosen at 905 megaHertz, whereas the frequency of the tone modulated carrier for the other transmitted signal $f_1$ from the source 26 is at 925 megaHertz. Thus their mean center frequency is 915 megaHertz, and the resonant tank circuit frequency is 1,830 megaHertz. These particular frequencies are selected to fall within the available spectrum transmission bands available for such purposes in the United States. On the other hand, to comply with international broadcast standards, it is contemplated that the system would for example be designed to have a resonant tank circuit frequency of about 4,900 megaHertz with transmitter frequencies of around 2,420 and 2,480 megaHertz.

In operation, when both transmitted signals $f_1$ and $f_2$ are received by the transponder antenna loop 38, they are mixed through the non-linear impedance effect of the semiconductor diode 36 to initiate tank circuit oscillation at its resonant frequency, which is equal to the sum of the $f_1$ and $f_2$ frequencies. Increased mixing and overall transponder efficiency is enhanced through use of a planar diode exhibiting high-speed switching, low RF threshhold and low forward bias. Significantly, lower-priced germanium diodes are preferred because of their relatively low threshold of about 0.3 volts, as compared to higher-priced silicon diodes with thresholds of 0.6 volts.

The approximate two percent frequency separation between the transmitted signals provides important advantages in maximizing transponder efficiency and in the ability of the system to avoid false alarms because the transponder return signal "stands out" from that might be produced by dissimilar metal objects such as umbrellas, shopping carts and the like, which have tended to cause false alarms with previous systems. In particular, the bandwidth of the transponder 34 relative to the incident radio frequencies is broadened without reducing its efficiency because the receiver antenna 38 can be tuned to fall anywhere between the two transmitter frequencies, which also minimizes the effects of "body detuning" in that the downward shift in frequency due to such dielectric loading effects can easily be accommodated within this range. This results from the fact that tuning or detuning of the antenna 38 more toward one transmitter frequency than the other only serves to enhance the signal strength at that frequency without reducing mixer conversion efficiency because proper radio frequency mixing can occur with power ratios of ten to one or greater between the signals.

Moreover, because of the cross polarization of the two frequencies transmitted from each of the antennas 14 and 16, their propagation from one transmitter location to remote locations outside of the surveillance area is seldom the same for both signals. A freak reflection pattern that may result in one transmitted signal being concentrated on a transponder at a remote location will almost never result in the other oppositely polarized transmission being reflected in the same pattern to reach the same area with sufficient power. Consequently, if only one signal is received, the non-linear impedance of the diode 36 can produce only a frequency-doubling effect, instead of the necessary mixing effect, so that the resulting return signal is at a frequency widely displaced from that of the desired transponder return. For example, with the current system parameters, a transponder would produce doubling frequencies of 1,810 or 1,850 megaHertz, both displaced by a full 20 megaHertz from the normal return frequency at 1,830 megaHertz. These displaced frequencies would be subject to considerable attenuation in the tuned tank circuit and is readily distinguishable by conventional filtering techniques from a legitimate mixed frequency response at 1,830 megaHertz level.

In this regard, signals picked up by the receiver antenna 22 and 24 on either side are applied through a conventional mixer connection 40 to a narrow band tone modulated receiver 42. The mixing of the two transmitted signals in the transponder return signal permits the response of the receiver 42 to be restricted to very narrowband operation that serves to eliminate false alarm responses due to extraneous noise and transmission signals from other sources. Indeed the receiver bandwidth needed is for the most part dependent only upon the frequency stability of the transmitter sources 26 and 30, thus permitting a very narrow detection "window" corresponding to the possible transmitter frequency shift. With very stable transmitter oscillator sources as hereinafter described, the bandwidth of the received signals available for detection of the modulating tone (i.e., the predetection bandwidth) can be extremely narrow, and the bandwidth of the receiver (post detection) can be further narrowed in precise detection of the modulating tone. Moreover, system reliability and sensitivity is further enhanced by having the receiver 42 supply an output signal to actuate an alarm 44 only when the strength of the modulating tone signal detected exceeds a selected minimum amplitude level for a predetermined fixed interval to insure the actual presence of a transponder within the detection zone.

Figure 3:
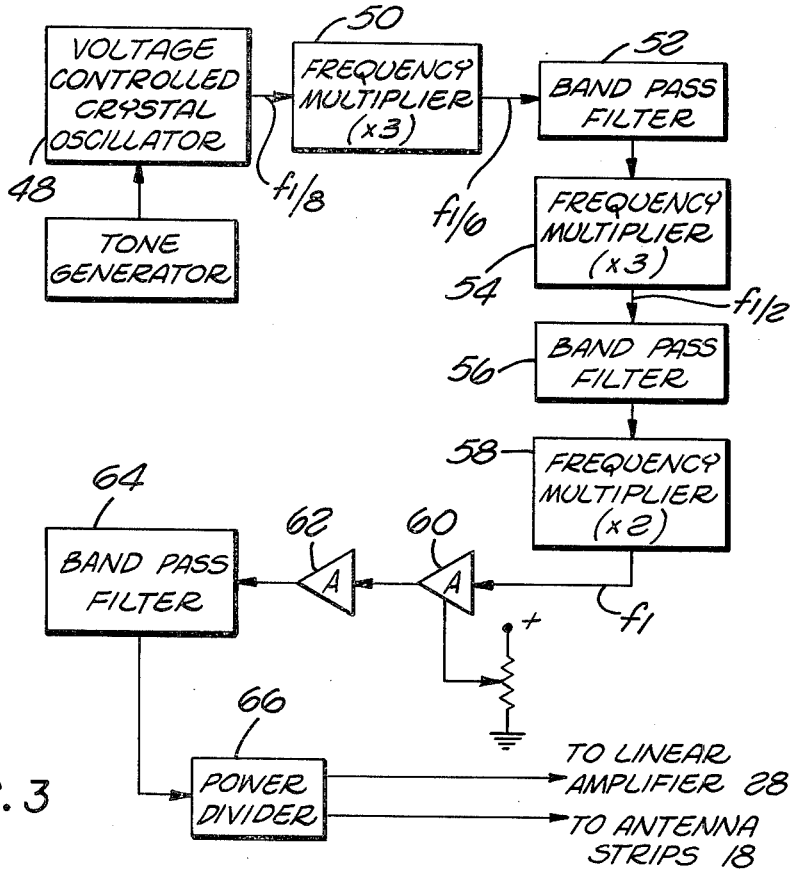
FIG. 3 is a more detailed block and circuit diagram schematic illustrating a preferred form of the narrow band tone modulated RF transmitter of FIG. 1.

Referring now to FIG. 3, the preferred embodiment now in operation generates the transmitter signal $f_1$ as a very stable, narrowband frequency modulated signal to maximize system sensitivity and selectivity. A stable tone generator 46 of conventional design, which may be a simple RC type, generates a fixed frequency tone in the audio range of one to twenty kiloHertz. This tone, which in the current system is at 2 kiloHertz, is applied as a modulating signal to a voltage controlled crystal oscillator 48 to frequency modulate its output. In the preferred embodiment, the crystal oscillator 48 is of conventional design with precise temperature compensation capable of holding a frequency stability of 0.7 cycles per million from 5° C. to 45° C. at a frequency of approximately 51.4 megaHertz. The amplitude of the modulating signal from the tone generator 46 applied to the voltage control circuit is adjusted to produce a maximum frequency deviation of plus or minus only about 0.25 to 0.30 kiloHertz, thus resulting in only very narrowband modulation of the oscillator carrier. The modulated output of the oscillator 48 is then applied to a conventional frequency multiplier 50 which triples the oscillator frequency that is then applied to a narrowband two pole bandpass filter 52. This filtered multiplier signal is then applied to another conventional frequency multiplier 54, which again triples the available frequency to be applied to another narrowband pass filter 56. The filtered output from the bandpass filter 56 is then applied to yet another frequency multiplier 58 that this time only doubles the input frequency to produce the desired modulated output signal ($f_1$) at 925 mega- Hertz with a narrowband modulation deviation of plus or minus 5 kiloHertz, which is then applied to a variable gain RF amplifier 60 and power amplifier 62. This amplifier transmitter signal $f_1$ is passed through a narrowband three pole bandpass filter 64 to a power divider 66 that delivers the transmitter signal to the vertical antenna strips 18 on the transmitter array 14 of the pedestal 10, and also through a lightweight cable connector to the linear amplifier 28 on the other pedestal 12.

Figure 4:
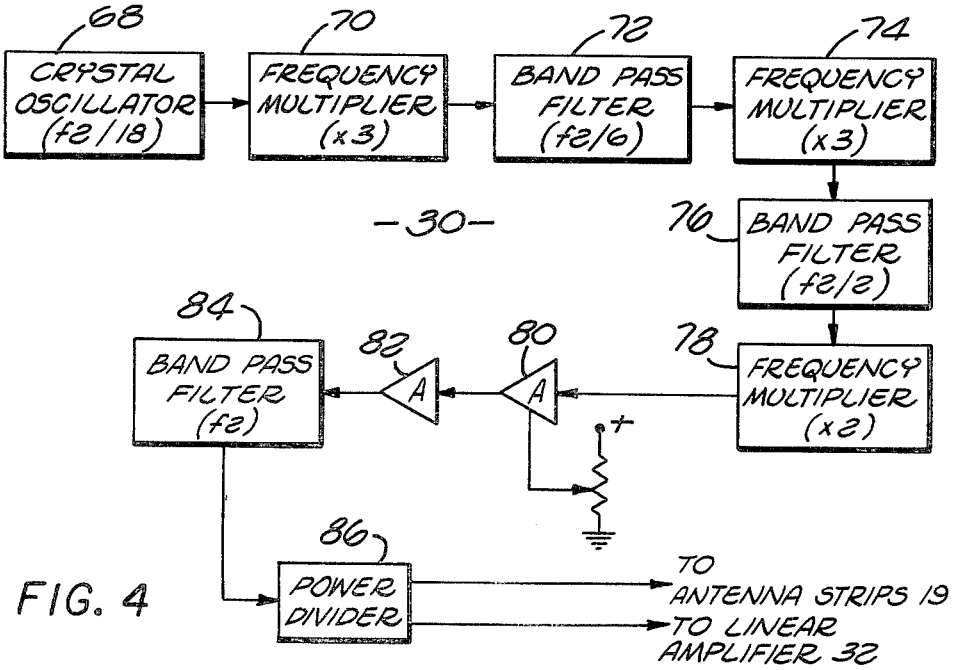
FIG. 4 is a detailed block circuit diagram showing the preferred form of a continuous wave RF transmitter of FIG. 1.

Referring now to FIG. 4, the other transmitter frequency $f_2$ is generated in a similar fashion using a conventional temperature compensated, crystal oscillator 68 that is capable of holding the frequency to 0.5 parts per million from 5° C. to 45° C. with an output frequency of about 50.3 megaHertz. This output frequency is tripled by frequency multiplier 70 to be filtered by a two pole bandpass filter 72. The narrowband output from the filter 72 is then applied to another frequency multiplier 74 which again triples the frequency to be applied through another two pole bandpass filter 76, and the filtered output frequency is then doubled in a final frequency multiplier 78 to produce the desired $f_2$ signal at 905 megaHertz. The $f_2$ signal is applied to the input of an RF variable gain amplifier 80 and the further amplifier stage 82 to reach a desired transmitting power level. The amplified output is then filtered through a narrowband, three pole bandpass filter 84 to remove any amplified distortions or harmonics and apply it to a power divider 86 to be applied directly to the antenna strips 19 and the transmitter array 14 on the pedestal 10 and through an appropriate RF coupling to the respective linear amplifier 32 on the opposite pedestal 12. Because of the great efficiency and sensitivity achieved, the transmitted power of these signals is an order of magnitude below that required in earlier systems, thus negating any health concerns about possible tissue damage from microwave transmissions.

Figures 5, 6:
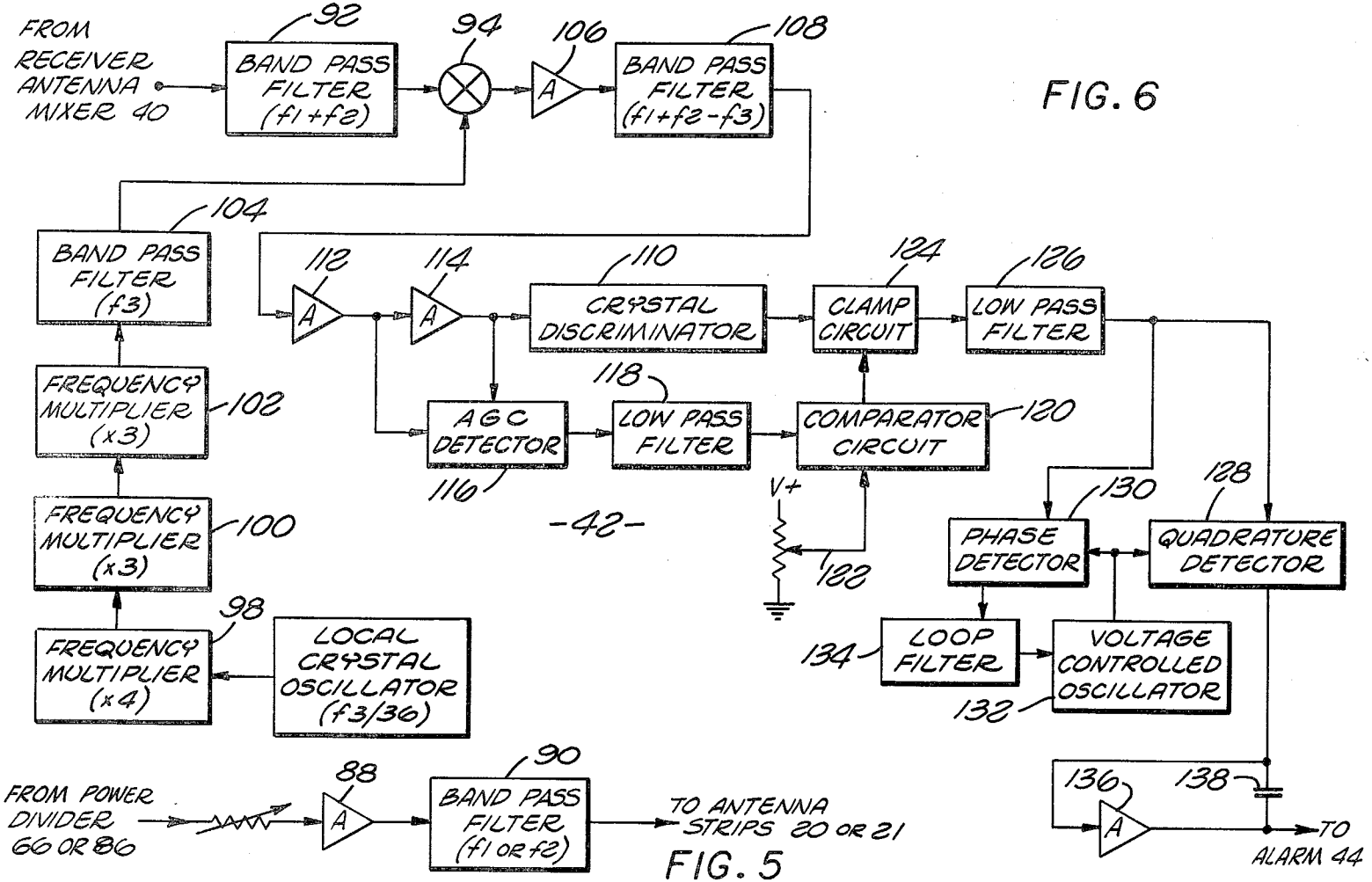
FIG. 5 is a block and circuit diagram illustrating a preferred form of the linear amplifiers shown in FIG. 1; and, FIG. 6 is a detailed block and circuit diagram illustrating the preferred form of the narrow band tone modulated receiver of FIG. 1 wherein the transmitted signal is frequency modulated.

Referring to FIG. 5, the respective $f_1$ and $f_2$ signal outputs from the power divider 66 or 86 can be connected to the respective linear amplifiers 28 and 32 on the opposite antenna pedestal 12 by simple wire leads or lightweight cable, thus eliminating the need for the expensive and difficult installation of heavy and bulky RF cable connections required in previous systems to avoid power loss. Linear amplifiers 28 and 32 each simply consist of a variable radio frequency amplifier stage 88, the output of which is applied through a narrowband three pole bandpass filter 90 to remove any signal distortion or noise picked up on the connecting line or generated in the amplification process. The gain of the amplifier stage 88 is adjusted to restore the transmitter signal strength to approximately the same level being supplied to the transmitter antenna segments on the opposite side.

Referring now to FIG. 6, in the preferred embodiment employing narrow band frequency modulation of the $f_1$ transmitter signal, the signals picked up by the receiver antennas 22 and 24 are applied through the mixer 40 to a very narrow band, four-pole band pass filter 92, the passband being centered at the mean frequency of the mixed transponder return signal—for example, at 1830 megaHertz. In the particular system being described, a valid return signal from the transponder 34 is frequency modulated with a single fixed audio tone, preferably at 2 kiloHertz to provide a maximum deviation of only 5 kiloHertz on either side of the 1830 megaHertz carrier frequency. The band pass filter is designed to reject the lower frequency transmitter signals by a minimum of 60 db to prevent internal mixing due to circuit nonlinearities. A filtered output from the bandpass filter 92 is applied to a double balanced mixer 94 to be mixed with lower side injection frequency $f_3$ at 1808.600 megaHertz, for example, from a stable local oscillator source to produce an intermediate frequency (IF) output of 21.4 megaHertz at its output when a valid transponder return signal is present. This lower side injection frequency is likewise generated from a highly stable, temperature compensated crystal oscillator 96 operating at about 50.24 megaHertz. This oscillator frequency is initially quadrupled in a frequency multiplier 98 and applied successively through two tripling frequency multipliers 100 and 102 to a four-pole narrow band pass filter 104 to supply the lower side injection signal to the mixer 94.

The intermediate frequency output of the balanced mixer 94 is applied to a low noise amplifier 106 to establish the overall receiver noise figure at 12 db to be fed into a four-section monolithic crystal band pass filter 108, preferably the Model 1619–1622 produced by Piezo Technology, Inc. under its registered trademark "COMLINE", wherein the response of amplitude versus frequency is 30 kiloHertz at the −3 db points. The crystal band pass filter 108 effectively determines the predetection band width, and along with the 12 db noise figure and modulation index of five, provides an overall receiver sensitivity of −113 dbm for a 20 db S+N/N ratio at the output of a crystal discriminator 110 described in more detail hereinafter. The output from the crystal band pass filter 108 passes through successive RF amplifier stages 112 and 114, each of which is provided on a chip with automatic gain control capability, to provide the desired input level to the crystal discriminator 110. The output of each stage 112 and 114 caused the respective automatic gain control circuits to generate a direct current proportional to the amplitude of the output. These respective AGC levels from the individual stages 112 and 114 are summed together to operate as an overall automatic gain detector 116 whose output is a direct current proportional to the combined output amplitude of each stage which is indicative of the initial transponder signal strength from band pass filter 108. This combined AGC detector output is fed to a low pass filter 118 having a predetermined time constant to produce a gradually increasing charge at a rate proportional to the strength of the transponder return signal being detected. The output charge from the low pass filter 118 is delivered to a comparator circuit 120 to be compared with a preselected threshold level established by the sensitivity setting on a potentiometer 122.

In the preferred form of the system, the crystal discriminator 110 consists of a monolithic crystal filter of the type available from Piezo Technology, Inc. as its Model 2378F which is combined with an RCA integrated circuit Model CA3089E as described in the pertinent data sheet, to produce an extremely narrowband stable discriminator with a bandwidth in the order of only 30 kiloHertz. With a valid transponder return signal, the output of the discriminator 110 constitutes the modulating audio tone, which in the existing system is at two kiloHertz. However, the output of the discriminator 110 is maintained at ground potential by a clamp circuit 124 until a triggering output from the comparator circuit 120 indicates that the charge built up on the low pass filter 118 exceeds the selected sensitivity setting from the potentiometer 122. This permits the system to be set at a sensitivity level that ignores transitory or weak return signals from remote transponders or other sources.

Once the clamp circuit 124 is open, the two kiloHertz audio tone is applied through a low pass filter 126 to be decoded by conventional phase locked loop techniques using a quadrature detector 128 and phase detector 130 that is capable of acquiring any steady tone within 10% of the modulating tone frequency established as the free running frequency of voltage controlled oscillator 132. In the conventional manner, the output of the phase detector 130 is applied to a loop filter 134 to produce a signal for adjusting the frequency and phase of the voltage controlled oscillator 132 to achieve phase lock. The quadrature detector 128 then provides its output to a conventional operational amplifier 136 having feedback capacitor 138 that maintains an output signal for triggering a suitable alarm 44 for providing an audible or visual response for a selected time interval no matter how brief the initial response. In this manner, the strong response produced by the presence of a transponder in the surveillance area between the antenna pedestals 10 and 12 initiates a full scale alarm response no matter how quickly the protected item is moved through the area, but the system is able to ignore even continued low level response signals from outside of the immediate protected area.

Although the system has been described in connection with a preferred embodiment employing specifically described circuit elements and techniques with their operating parameters pertinent to an existing preferred embodiment using audio tone frequency modulation, it should be understood that the invention may be implemented employing various modifications and variations of the circuit elements and techniques without departing from the spirit or scope of the invention as defined in the appended claims. For example, the system might be implemented to employ amplitude modulation of one of the transmitted radio frequencies, rather than frequency modulation, or to employ modulating tones outside the sudio range without discarding the basic operational advantages inherent in this unique overall system approach.

What is claimed is:

1. A system for detecting the presence of an article within a surveillance area comprising:

(a) transmitter means for radiating two radio frequency signals at two distinct different frequencies within the surveillance area, said radio frequencies being sufficiently close together to be received by a single transponder;

(b) said transmitter means including antenna means for each of the said two radio frequency signals arranged so that the ratio of field strengths of said two signals is substantially uniform throughout the surveillance area;

(c) transponder means removably affixed to protected articles capable of being moved with an article into said surveillance area, said transponder means having a antenna tuned to receive the radio frequency signals transmitted at both frequencies and a non-linear impedance element coupled to said antenna means, whereby said transponder means reradiates a return signal having a frequency equal to the sum of the frequencies of the two transmitted radio frequency signals;

(d) narrowband receiver means for receiving said return signal to the exclusion of the transmitted radio frequency signals and their harmonics; and (e) alarm means responsive to the detection of said return signal by said narrowband receiver means.

2. A system according to claim 1 in which said two different frequencies differ from each other by about 2% of a mean center frequency which is midway between said two different frequencies.

3. A system according to claim 1 in which one of said two radio frequency signals is modulated.

4. A system according to claim 3 in which the modulated radio frequency signal is frequency modulated by a fixed audio frequency tone.

5. A system according to claim 3 in which receiver means comprise means including phase locked loop circuitry for decoding the modulation of the modulated radio frequency signal.

6. A system according to claim 3 in which said narrowband receiver means includes receiver antenna means for picking up said return signal, filter means for rejecting all signals picked up by the antenna except those within a narrow pass band at the frequency of said return signal, signal amplitude detection means for generating a comparison output level indicative of the amplitude of the filtered return signal, and demodulation means responsive to the comparison output level for detecting the modulation only when said comparison level exceeds a preselected level setting.

7. A system according to claim 6 in which said signal amplitude detection means includes a local oscillator, mixer means for deriving an intermediate frequency signal, and a band pass filter for said intermediate frequency signal.

8. A system according to claim 1 in which the transmitter means includes a temperature compensated crystal controlled oscillator, frequency multiplier means, and narrowband filter means.

9. A system according to claim 1 in which said transmitter means includes signal source means, antenna means located remote from said source means, linear amplifier means in proximity with said antenna means, and connector means for delivering a signal from said source means to said linear amplifier means.

10. A system according to claim 1 in which the antenna of said transponder means is tuned to a frequency intermediate to said two distinct different frequencies and said non-linear impedance element is connected to said antenna means so as to provide a tank circuit with a resonant frequency equal to the sum of said two distinct different frequencies for reradiating a return signal at said resonant frequency.

11. Apparatus according to claim 1 in which one of the radio frequency signals is modulated by a fixed audio frequency tone to produce a narrowband frequency modulation and the other is transmitted as a continuous wave at a fixed radio frequency, and in which said receiver means includes a receiver antenna, filter means for rejecting signals received by said antenna outside of a narrow pass band at the frequency of said return signal, means for generating an intermediate frequency for demodulation of signals within said pass band, amplifier means for amplifying said intermediate frequency signal and generating a comparison level output indicative of the amplitude of said intermediate frequency, narrowband discriminator means responsive to said comparison level output for demodulating said intermediate frequency to derive said audio frequency modulation only when the amplitude of said comparison level output exceeds a preselected threshold value, a phase locked loop detector tuned to the frequency of said fixed audio tone to generate an alarm output upon detection of said fixed audio tone, and operational amplifier means coupled to receive said alarm output to actuate an alarm for a fixed time period following initiation of each such alarm output.

12. A system according to claim 1 in which said receiver means decodes the return signal without reference signals derived from the transmitter means.

13. A system according to claim 1 in which said two distinct different frequencies differ from a mean center frequency by equal and opposite amounts and said mean center frequency is about 915 MHz.

* * * * *